US007377389B2

(12) United States Patent
Avalos-Guzman et al.

(10) Patent No.: US 7,377,389 B2
(45) Date of Patent: May 27, 2008

(54) SYSTEM AND METHOD FOR HERMETIC PACKAGING OF GLASS SHEETS

(75) Inventors: Rafael Avalos-Guzman, Estado de México (MX); Jorge Sanchez-Gonzalez, Col. La Escalera (MX); Guillermo Garcia-Castillo, Mexico City (MX)

(73) Assignee: IP Vitro Vidrio Y Crystal, Ltd., Givisiez (CH)

( * ) Notice: Subject to any disclaimer, the term of this patent is extended or adjusted under 35 U.S.C. 154(b) by 389 days.

(21) Appl. No.: 10/894,844

(22) Filed: Jul. 19, 2004

(65) Prior Publication Data

US 2005/0011779 A1 Jan. 20, 2005

(30) Foreign Application Priority Data

Jul. 17, 2003 (MX) ..... NL/A/2003/000022

(51) Int. Cl.
*B65D 19/00* (2006.01)
*B65D 85/48* (2006.01)

(52) U.S. Cl. ..... 206/454; 206/204; 206/449; 53/445

(58) Field of Classification Search ..... 206/204, 206/205, 449, 451, 454; 53/445, 442
See application file for complete search history.

(56) References Cited

U.S. PATENT DOCUMENTS 2,973,089 A * 2/1961 Brichard et al. ..... 206/205
3,335,932 A * 8/1967 Brown ..... 206/453
3,349,900 A * 10/1967 Jones et al. ..... 206/205
3,451,542 A * 6/1969 Bundy et al. ..... 206/451
3,618,755 A * 11/1971 Kean et al. ..... 206/454
4,011,359 A * 3/1977 Simpkin et al. ..... 428/326
4,127,683 A * 11/1978 Flemmer et al. ..... 427/287
4,200,670 A * 4/1980 Albach ..... 427/154
5,105,946 A * 4/1992 McDowell ..... 206/454
5,644,898 A * 7/1997 Shepherd et al. ..... 53/445

* cited by examiner

*Primary Examiner*—David T. Fidei
(74) *Attorney, Agent, or Firm*—Abelman, Frayne & Schwab

(57) ABSTRACT

A system and method for hermetic packaging of glass sheets, that includes applying to the glass sheets surfaces that will be in contact with other adjacent glass sheets, from the cutting line, an anti-humidity chemical treatment that includes a watery solution from 1 to 2% in weight of a mixture of adipic and malic, adipic and citric, or malic and citric acids 50-50 in a dosage preferably between 100 and 400 mg/m$^2$, to protect glass against condensation humidity or rain. Sprinkling over said surfaces of the glass sheets, 500 to 700 mg/m$^2$ of separating powder of a selected granulometry less than 300 microns, forming a group of glass sheets. Placing a strip of cushioning material, such as the known as Polybubble Plastic, or corrugated cardboard, around the sides of the group of glass sheets, to provide a cushioning condition to the group of glass sheets during shipping and handling. Placing corners of cushioning material such as corrugated cardboard, in every corner of the group of glass sheets, on the strip of cushioning material. Wrapping hermetically the group of glass sheets along with the stripe and the cushioning material corners, with a thermo shrinking plastic of a determined thickness and preferably from 500 to 1000 caliber, forming a hermetic package. And applying heat to the package wrapped in plastic, to obtain a highly hermetic sealing, and placing the hermetic package in a container such as a frame or wooden box, in order to be handled as a hermetic package.

18 Claims, 2 Drawing Sheets

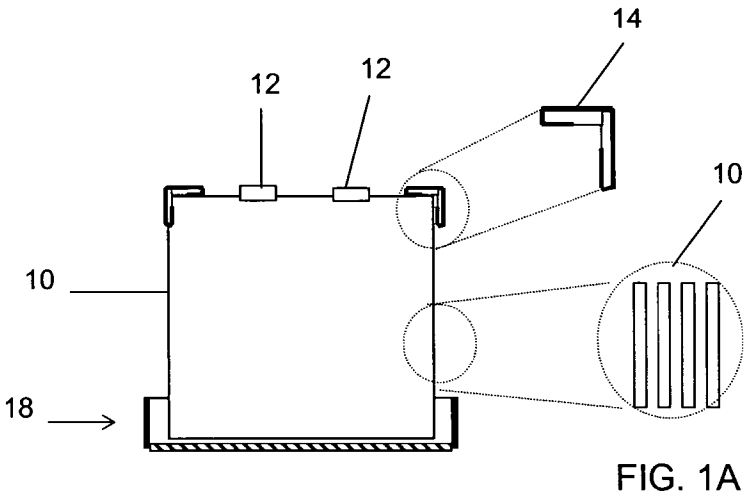
FIG. 1A
FIGURE 1
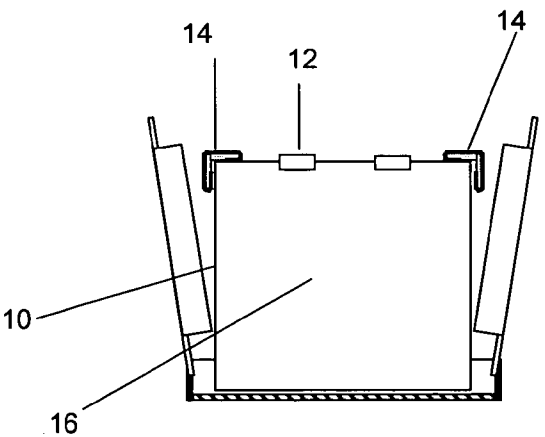
FIGURE 2

SYSTEM AND METHOD FOR HERMETIC PACKAGING OF GLASS SHEETS

FIELD OF INVENTION

The present invention refers to a hermetic packaging system and method for glass sheets, that has the purpose to protect glass sheets against glass deterioration risks caused by environmental air condensation humidity attacks or by rain wetness, as well as to handle and transport glass in a safe and reliable manner.

BACKGROUND OF THE INVENTION

To pack glass sheets in order to send them mainly to the Central and South American markets, as well as to countries where high temperature environmental conditions prevail and high relative humidity, during a long period of time the combination of wooden boxes, plastic to wrap glass and separating paper between glass sheets have been used.

Approximately, until 1992 the use of a packing consisting of a wooden box completely closed was discontinued. This closed box packing was used for glass shipments to certain critical destinations for their high temperature, humidity, and transport and handling conditions. Said packing was substituted by a box called "huacal" type, also known as light box, with a considerably less amount of wood, which has been used years before by reason of less cost of packing materials.

A separating paper has been considered indispensable to protect glass sheets mainly against damage risks caused by condensation humidity attack or by wetness, as it is the case of the Central and South American markets and countries where similar environmental conditions prevail.

The hermetic packaging system and method of the present invention, seeks mainly, the substitution of the separating paper thought the combination of materials and a hermetic condition in the packing that will allow the adequate protection of glass during handling and shipping to the customers warehouses, with a considerable economical saving between 41% and 54% of the packing materials cost and depending the glass thickness being handled.

SUMMARY OF THE INVENTION

It is therefore a main objective of the present invention, to offer a hermetic packaging system and method for glass sheets, that allows improving glass protection against staining by humidity condensation or wetness during storage and shipping to the client's warehouse.

It is also a main objective of the present invention, to offer a hermetic system and method for glass sheets, that will avoid claims from customers because of wet and stained glass problems.

It is also another main objective of the present invention, to offer a hermetic packaging system and method for glass sheets, that guarantees the required protection of the glass sheets against abrasion risks between glass sheets, during shipping.

It is yet another main objective of the present invention, to offer a hermetic packaging system and method for glass sheets, that will allow packing materials cost reduction, upon the substitution of separation paper for more economical materials.

It is furthermore a main objective of the present invention, to offer a hermetic packaging system and method for glass sheets, to facilitate operations on the premises through the elimination of the need to wrap glass in paper in the production line or warehouse, as well as to reduce the need to condition the storage area for paper rolls in the plant.

It is yet a main objective of the present invention, to offer a hermetic packaging system and method for glass sheets, that may contribute to the ecological conservation when using materials generating less harms to environment, eliminating the use of paper that represents less felling of trees of woods.

These and other objectives and additional advantages of the hermetic packaging system and method for glass sheets, of the present invention, will be evident to the experts on the subject, of the following detailed description.

BRIEF DESCRIPTION OF THE DRAWINGS

FIG. 1 is a side view of the hermetic packaging system, showing a first step of assembly in accordance with the present invention;

FIG. 1A is a side view of FIG. 1, showing a section of a group of flat glass sheets forming the hermetic package of the present invention;

FIG. 2 is a side view of the hermetic packaging system, showing a second step of assembly in accordance with the present invention.

DESCRIPTION OF THE SPECIFIC EMBODIMENTS OF THE INVENTION

Figure 3:
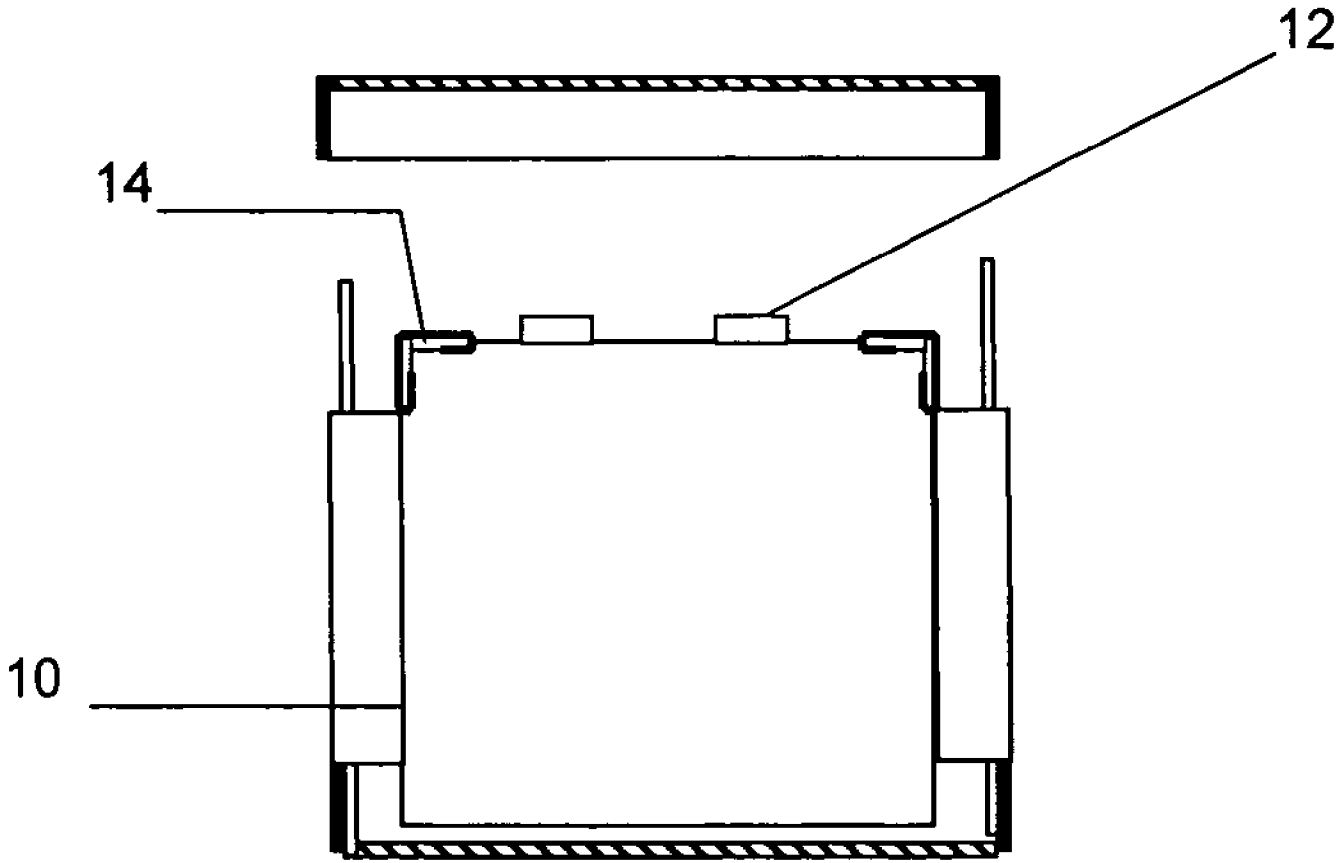
FIG. 3 is a side view of the hermetic packaging system, showing a second step of assembly in accordance with the present invention.

The hermetic packaging system, of the present invention, consists in a group formed by a package of flat glass sheets 10 that have, on the surface of every glass sheet that is in contact with another adjacent glass sheet, a coat of a mixture of adipic and malic, adipic and citric, or malic and citric acids 50-50 in a dosage preferably between 100 and 400 mg/m2 to eliminate the humidity condensation deterioration risks that might be originated between the same sheets of the glass package during storage and shipping time, and a coat of separating powder of selected granulometry less than 300 microns applied on the surface of every glass sheet; a strip of cushioning material 12, such as the known Polybubble Plastic or corrugated cardboard that surrounds the glass sheets edges; corners 14 with cushioning materials, such as corrugated cardboard, in every corner of the group of glass sheets; a coat of thermoshrinked plastic material with cushioning materials, such as corrugated cardboard, in every corner of the group of glass sheets; a coat of thermoshrinked plastic material 16 hermetically surrounding all the group of glass sheets 10 along with the strip 12 and corners 14 of cushioning material forming an hermetic package of glass sheets; and a container such as a frame or wooden box 18, of the known sort as END CAP that embraces all the hermetic package of glass sheets.

On the other hand, the hermetic packaging method of glass sheets, consists in applying to the surfaces of the glass sheets that will be in contact with other adjacent glass sheets, from the cutting line, a watery solution of 1 to 2% in weight of a mixture of adipic and malic, adipic and citric, or malic and citric acids 50-50 in a dosage preferably between 100 and 400 mg/m.sup.2, to protect the glass against condensation humidity; sprinkle on said glass sheets surfaces, 500 to 700 mg/m.sup.2 of separating powder of a selected granulometry less than 300 microns, forming a group of glass sheets; place a strip of cushioning material 12, such as the known as Polybubble Plastic, around the sides of the group of glass sheets 10, to offer a cushioning condition to the group of glass sheets during shipping and handling; place corners 14 of cushioning material such as corrugated cardboard, in every corner of the group of glass sheets, over the strip of cushioning material; wrap hermetically the group of glass sheets with strips and corners of cushioning material, with a thermo shrinking plastic 16, forming a hermetic package; apply heat to the hermetic package, to obtain a highly hermetic sealing; and place the hermetic package in a container such as a frame or wooden box 18, in order to be handled and shipped as a n hermetic package.

The polybubble plastic offers the glass package a cushioning condition during shipping and handling, and the cardboard corners have the purpose of protecting the glass edges and preventing any sharpened edge of a corner from cutting the thermo shrinking plastic.

Within every hermetic package, in its lower part, it is recommended to place a small amount of adipic acid, to minimize the possible damages on the glass surface, from water that for some reason might filter into the package.

The preparation of the boxes in the Shipping Area is undertaken in the following manner.

A. An END-CAP type wooden box 18 of the size corresponding to the group of glass sheets to be packed, is placed on the supporting cart. This box already contains the interior heels on which the glass sheets will rest.

B. A thermo shrinking plastic sheet 16 preferably 500 to 1000 caliber is placed on the wooden box 18. This plastic sheet must be previously cut in proper measures to fully cover the glass package by both faces, as well as to overlap approximately 50 cm in every overlapping point.

C. The polybubble plastic strip is placed to the sides, within the box 18 with enough length and width so as to cover all the edges of the glass package and extend approximately 30 cm from every side of the package towards the center of the faces of the same package, strips of corrugated cardboard with double face can also be used.

D. The glass package is introduced on the plastic in the wooden box, accommodating cardboard corners on each corner of the package, to ensure the purpose to prevent the rupture of the plastic with the sharpen edges of the glass sheets.

E. In the lower part of the package, between the wooden heels are placed tow desiccant containers.

F. The glass package is covered and shut with the thermo shrinking plastic temporally holding the plastic with adhesive tape strips. In this operation it must be observed that the plastic overlaps be done in such a way that in case of rain or wetness, the water draining do not penetrate into the glass sheets, but only flow on the plastic.

G. Through a portable gas burner with flame in a fan-like form, proceed to seal the package heating and softening the thermo shrinking plastic in the overlapping areas. Forming a seal when pressing by hand using a canvas glove.

It must finally be understood, that the invention is not limited exclusively to the above described specific embodiments of the hermetic packaging system as well as method for glass sheets, and that experts in the field will be able to perform changes in these forms that will be included in the real spirit and scope of the invention that is claimed next.

We claim:

1. A hermetic packaging system comprising: a group of glass sheets; an anti-humidity chemical treatment coat on the surface of every glass sheet that is in contact with other adjacent glass sheet, to control the condensation humidity that might be generated among the same; a separating powder coat of selected granulometry, on the surface of each glass sheet that is in contact with an adjacent glass sheet; a cushioning material stripe, surrounding the glass sheets edges; corners of cushioning material, in every corner of the group of glass sheets; a coat of thermo shrinking plastic material that hermetically surrounds all the group of glass sheets along with the strip and cushioning material corners, forming a glass sheets hermetic package; and a container to ship and handle the hermetic package as a hermetic package.

2. The hermetic packaging system, as claimed in claim 1, wherein the anti-humidity chemical treatment coat is formed by a mixture of adipic and malic, adipic and citric, or malic and citric acids 50-50 in a dosage preferably between 100 and 400 mg/m.sup.2.

3. The hermetic packaging system, as claimed in claim 1, wherein the separating powder coat of selected granulometry is less than 300 microns.

4. The hermetic packaging system, as claimed in claim 1, wherein the separating powder coat of selected granulometry is applied in an amount of 500 to 700 mg/m.sup.2.

5. The hermetic packaging system, as claimed in claim 1, wherein the cushioning material strip, surrounding the sides of the glass sheets, is the one known as polybubble plastic.

6. The hermetic packaging system, as claimed in claim 1, wherein the cushioning material stripe, surrounding the sides of the glass sheets, is corrugated cardboard.

7. The hermetic packaging system, as claimed in claim 1, wherein the cushioning material corners, are corrugated cardboard.

8. The hermetic packaging system, as claimed in claim 1, wherein the plastic used to make the hermetic packaging is thermo shrinking polyethylene plastic preferably 500 to 1000 caliber.

9. The hermetic packaging system, as claimed in claim 1, wherein the container is a frame or wooden box that embraces all the hermetic package of glass sheets.

10. The hermetic packaging system, as claimed in claim 1, further comprises a small amount of adipic acid within the hermetic package, in its lower part, to minimize possible damage to the glass surface, from water that for any reason enters the interior of the package.

11. A hermetic packaging method of glass sheets, comprising the steps of: a) applying to the glass sheets surfaces that will be in contact with other adjacent glass sheets, from the cutting line, a coat of an anti-humidity chemical treatment, to protect the glass against condensation humidity and wetness. b) sprinkling on said glass sheets surfaces, a separating powder of a selected granulometry, forming a group of glass sheets; c) placing a cushioning material strip around the sides of the group of glass sheets, to provide a cushioning condition to the group of glass sheets during shipping and handling; d) placing cushioning material corners in every corner of the group of glass sheets, on the cushioning material strip; e) hermetically wrapping the group of glass sheets along with the strip and the cushioning material corners, with a thermo shrinking plastic preferably of 500 to 1000 caliber, forming a hermetic package. f) applying heat to the hermetic package, in order to obtain a highly hermetic sealing; and g) placing the hermetic package in a container; to be handled and shipped as a hermetic package.

12. The hermetic packaging method, as claimed in claim 10, wherein the anti-humidity chemical treatment coat includes a watery solution from 1 to 2% in weight of a mixture of adipic and malic, adipic and citric, or malic and citric acids 50-50 in a dosage preferably between 100 and 400 mg/m.sup.2.

13. The hermetic packaging method, as claimed in claim 10, wherein the separating powder coat has a selected granulometry less than 300 microns.

14. The hermetic packaging method, as claimed in claim 10, wherein the separating powder coat of selected granulometry, is applied in an amount from 500 to 700 mg/in-.sup.2.

15. The hermetic packaging method, as claimed in claim 10, wherein the cushioning material strip, that surrounds the sides of the glass sheets, is known as polybubble plastic.

16. The hermetic packaging method, as claimed in claim 10, wherein the cushioning material strip, that surrounds the sides of the glass sheets, is corrugated cardboard.

17. The hermetic packaging method, as claimed in claim 10, wherein the cushioning material corners, are made up of corrugated cardboard.

18. The hermetic packaging method, as claimed in claim 10, further includes a small amount of adipic acid inside the hermetic package, in its lower part, to minimize the possible damage to the glass, from water that for any reason enters the interior of the package.

* * * * *